US007507084B2

(12) United States Patent
Chiles et al.

(10) Patent No.: US 7,507,084 B2
(45) Date of Patent: Mar. 24, 2009

(54) REGENERATIVE FUME-INCINERATOR WITH ON-LINE BURN-OUT AND WASH-DOWN SYSTEM

(75) Inventors: Joseph David Chiles, Rancho Cucamonga, CA (US); Jeffrey J. Yerkes, Rancho Cucamonga, CA (US); John G. Kirkland, Rancho Cucamonga, CA (US); Agustin Cabarlo, Rancho Cucamonga, CA (US); Anu D. Vij, Rancho Cucamonga, CA (US)

(73) Assignee: Pro-Environmental Inc, Rancho Cucamonga, CA (US)

( * ) Notice: Subject to any disclaimer, the term of this patent is extended or adjusted under 35 U.S.C. 154(b) by 399 days.

(21) Appl. No.: 11/281,858

(22) Filed: Nov. 17, 2005

(65) Prior Publication Data

US 2006/0073430 A1 Apr. 6, 2006

Related U.S. Application Data

(62) Division of application No. 10/732,600, filed on Dec. 9, 2003, now Pat. No. 7,017,592.

(60) Provisional application No. 60/432,196, filed on Dec. 10, 2002.

(51) Int. Cl.
*C10L 10/00* (2006.01)
*F23D 11/44* (2006.01)

(52) U.S. Cl. ..... 431/3; 431/215; 431/5; 134/22.1

(58) Field of Classification Search ..... 432/181, 432/180; 431/5, 3, 215; 134/18, 22, 1
See application file for complete search history.

(56) References Cited

U.S. PATENT DOCUMENTS

| | | | | | |
|---|---|---|---|---|---|
| 4,957,430 | A * | 9/1990 | Goodfellow | ..... | 432/28 |
| 5,098,286 | A * | 3/1992 | York | ..... | 432/181 |
| 5,217,373 | A * | 6/1993 | Goodfellow | ..... | 432/181 |
| 5,259,757 | A * | 11/1993 | Plejdrup et al. | ..... | 432/181 |
| 6,261,093 | B1 * | 7/2001 | Matros et al. | ..... | 432/181 |
| 2007/0033873 | A1 * | 2/2007 | D'Souza | ..... | 48/198.7 |

* cited by examiner

*Primary Examiner*—Kenneth B Rinehart
*Assistant Examiner*—Chuka C Ndubizu
(74) *Attorney, Agent, or Firm*—Melanius D'Souza

(57) ABSTRACT

A method and apparatus for on-line wash-down of a heat sink media bed in a regenerative heat exchanger of a regenerative fume incinerator is disclosed. When a heat sink media bed requires cleaning, the selected regenerative heat exchanger is cooled while the remaining regenerative heat exchangers are operated in their normal mode of operation. When the selected media bed reaches a temperature which is less than the thermal-shock temperature of the media material, a cleaning fluid is sprayed on the media surfaces through spray-pipes which are installed within the media bed. After the media surfaces are washed down, the selected regenerative heat-exchanger is reverted back to its normal mode of operation. The regenerative heat exchanger can also be automatically burnt-out of deposited gasifiable matter prior to the wash-down. Random or sequential burn-out and wash-down of the regenerative heat-exchangers can be performed. The apparatus can also be used to suppress fires within the media bed by spraying cold water on the media bed when a rapid rise in temperature is detected within the media bed.

24 Claims, 5 Drawing Sheets

REGENERATIVE FUME-INCINERATOR WITH ON-LINE BURN-OUT AND WASH-DOWN SYSTEM

CROSS-REFERENCE TO RELATED APPLICATIONS

This patent application is a Divisional Application of U.S. application Ser. No. 10/732,600 dated Dec. 9, 2003 now U.S. Pat. No. 7,017,592 which claims priority from U.S. provisional patent application No. 60/432,196 filed on Dec. 10, 2002.

BACKGROUND OF THE INVENTION

The present invention generally relates to an improved method and apparatus for on-line cleaning of deposited matter from the surfaces of the heat-sink media in Regenerative Fume Incinerators (RFIs). Specifically, it covers a system for washing down the deposited matter from the heat transfer surfaces of the heat sink media (HSM) within a Regenerative Heat Exchanger (RHX) of a regenerative fume incinerator.

Regenerative fume incinerators are widely used in industry to clean polluted gas streams containing combustible pollutants before the gas stream is exhausted to the atmosphere. As used herein, the term "Regenerative Fume Incinerator" includes Regenerative Thermal Oxidizers (RTOs), Regenerative Catalytic Oxidizers (RCO) and Thermal Catalytic Oxidizers (TCO).

Regenerative thermal oxidizers, regenerative catalytic oxidizers, and thermal catalytic oxidizers use different oxidation processes to destroy the pollutants in the polluted gas stream. As defined herein, a regenerative thermal oxidizer maintains a high operating temperature (between 1,200 to 2,000 degrees F.) in the combustion chamber to facilitate the oxidation of the pollutants in the polluted gas stream. Regenerative thermal oxidizers have been well described in the prior art such as U.S. Pat. No. 5,098,286 to York, U.S. Pat. No. 5,259,757 to Plejdrup et al. and others. Briefly, a regenerative thermal oxidizer generally comprises a combustion chamber in fluid communication with a plurality of regenerative heat exchangers. The polluted gas is first passed through a previously heated regenerative heat exchanger and is preheated to a high temperature. The preheated polluted gas is then passed into the combustion chamber where it is further heated to a temperature high enough for generally complete oxidation of the combustible pollutants to a cleansed gas containing harmless end-products such as water and carbon-dioxide. The cleansed hot gas is then passed into a second regenerative heat exchanger which was previously cooled by the passage of the cold polluted gas through it. The cleansed hot gas releases its sensible heat to the relatively cooler heat sink media in the second regenerative heat exchanger which gets heated for use in a subsequent preheating cycle as described above. The cold polluted gas and cleansed hot gas are alternately passed through the two regenerative heat exchangers to maintain continuity of flow and heat transfer between the cold and hot gas streams.

As is well known and practiced in the art, more than two regenerative heat exchangers can be used for increased capacity and to enhance the pollutant destruction capability of the regenerative fume incinerator. A regenerative thermal oxidizer with more than two regenerative heat exchangers, which uses a purge system to recycle entrapped polluted gas, is described in the aforementioned patent to York.

A regenerative catalytic oxidizer is defined herein as a regenerative fume-incinerator that is designed similar to a regenerative thermal oxidizer. However, it includes a catalyst to facilitate the oxidation of the pollutants in the polluted gas stream at a relatively lower temperature (about 400 to 800 degrees F.) to save energy.

A thermal catalytic oxidizer is defined herein as a regenerative fume-incinerator which is a hybrid regenerative catalytic oxidizer and regenerative thermal oxidizer. A thermal catalytic oxidizer is designed to operate initially at a relatively lower oxidizing temperature (about 400 to 800 degrees F.) using a catalyst (as in a regenerative catalytic oxidizer) and to operate at a high oxidizing temperature (about 1,200 to 2,000 degrees F. as in a regenerative thermal oxidizer) after the catalyst is deactivated. This feature provides operating flexibility.

It is well known in the art that the relatively densely packed heat sink media in the regenerative heat exchangers of regenerative fume incinerators is quite susceptible to fouling due to the deposition of condensable and non-condensable aerosols in the polluted air streams. Since the fouling tends to vitiate the performance of the regenerative fume incinerator, techniques have been developed to clean the heat sink media in fouled regenerative heat exchangers. For example, Plejdrup et al. describe a method of cleaning the condensed combustible matter from the heat transfer surfaces of the heat sink media in a regenerative thermal oxidizer by passing the hot oxidized gas through a fouled regenerative heat exchanger bed for an extended period of time. However, while this "burn-out" (also referred to as "bake-out") method is useful for removing combustible deposited matter, it is not very useful in removing non-combustible deposited matter from the regenerative heat exchanger.

U.S. Pat. No. 6,579,379 to Noble describes a method (the Noble method) and apparatus to remove deposited matter from the surfaces of the heat sink media in a regenerative heat exchanger. However, the Noble method suffers from various disadvantages, the primary one of which is that it is mostly manual in nature. In the Noble method, the regenerative fume incinerator has to be shutdown and cooled to ambient temperature before the cleaning apparatus is manually assembled and operated within the regenerative fume incinerator. The shut-down and cooling requirement results in an interruption of production for a fairly long period of time. The Noble method also requires additional time to manually assemble and disassemble the cleaning apparatus in the regenerative fume incinerator. These time requirements result in lost revenue and profits for the regenerative fume incinerator user. Further, the Noble method is not effective against sticky combustible deposited matter which cannot be easily dissolved by a water wash. Therefore, a burn-out operation is required to gasify the sticky combustible deposited matter prior to the wash-down. Cooling the regenerative heat exchanger bed from the higher burn-out temperature requires additional time which further increases loss of production.

As a particular example, regenerative fume incinerators used in the wood industry are subjected to fouling by fine wood particles as well as sticky condensable combustible resin particles. This is a particularly difficult fouling situation which requires that the regenerative heat exchanger be first subjected to a burn-out operation to remove the combustible deposited matter and then washed out to remove the residual non-combustible deposited matter such as inorganic salts which are present in wood particles. The Noble method is not particularly well suited to this application because, during the burn-out operation, the temperature of the heat sink media in the regenerative heat exchanger is raised to a higher level than normal to effect gasification of the combustible matter. Therefore, the regenerative fume incinerator takes a much longer time to cool to ambient temperature as required in the Noble method. Further, the Noble method requires operating personnel to open the regenerative fume incinerator and enter into a potentially hazardous confined area, thereby potentially jeopardizing the lives of the personnel. Yet further, the Noble method requires that all beds be cleaned during a cleaning operation. The Noble method does not disclose a way to selectively clean one or more of the regenerative heat exchangers in a regenerative fume incinerator as needed due to adverse fouling conditions associated with these regenerative heat exchangers.

There is therefore a need for a method and apparatus to burn-out and wash-down a regenerative heat exchanger bed while the regenerative fume incinerator is on-line with the process. The method has to be able to quickly and efficiently clean the regenerative heat exchanger bed without shutting down the regenerative fume incinerator and without cooling the regenerative fume incinerator to ambient temperature. The method should be safe to practice and should not require the entry of personnel into a hazardous confined area. Further, the method should be able to selectively clean-out one or more of the regenerative heat exchangers of a regenerative fume incinerator without shutting down the regenerative fume incinerator.

SUMMARY OF THE INVENTION

In one aspect of the present invention, a regenerative fume incinerator for cleaning a polluted gas containing organic and inorganic pollutants is disclosed. The regenerative fume incinerator comprises a combustion chamber and a plurality of regenerative heat exchangers. Each regenerative heat exchanger comprises a regenerative heat exchanger compartment having a hot end and a cold end. The cold end of the regenerative heat exchanger compartment is configured for fluid communication with a flow control means (FCM) for the selective introduction of the polluted gas into the regenerative heat exchanger compartment and for the selective removal of the cleansed gas from the regenerative heat exchanger compartment. The flow control means is located at the cold end of the regenerative heat exchanger and configured for fluid communication with the cold end of the regenerative heat exchanger compartment. The regenerative heat exchanger compartment further comprises a heat sink media bed located in between the cold and hot ends of the regenerative heat exchanger compartment in the path of flow of the polluted gas and the cleansed gas. A deposited matter removal means for physically dislodging deposited matter from the surface of the heat sink media is located within the regenerative heat exchanger compartment. The deposited matter removal means comprises at least one spray pipe containing a cleaning fluid, such as water or steam or compressed air. The cleaning fluid is supplied to the spray pipe at a pressure greater than the gas pressure within regenerative heat exchanger compartment. The spray pipe is located within the heat sink media bed to direct the cleaning fluid therein toward at least some of the surfaces of the heat sink media to physically dislodge the deposited matter thereon.

In another aspect of the present invention, a method of washing the heat sink media in a regenerative heat exchanger of a regenerative fume incinerator is disclosed. The regenerative heat exchanger has at least one spray pipe installed within it. The spray pipe is connected to a source of cleaning fluid such as water, steam or compressed air. The spray orifices on the spray pipe are generally directed towards the surface of the heat sink media within the regenerative heat exchanger. The inventive method comprises the steps of cooling the heat sink media to a temperature sufficient to prevent thermal shock to the heat sink media and introducing the cleaning fluid into the spray pipe to wash the surface of the heat sink media while the regenerative fume incinerator is on-line with the process.

In yet another aspect of the present invention, a regenerative fume incinerator control system to perform on-line wash-down of the regenerative heat exchanger media in a regenerative fume incinerator having a plurality of regenerative heat exchangers is disclosed. Each regenerative heat exchanger is equipped with at least one cleaning fluid spray pipe and a temperature measuring means. The regenerative fume incinerator control system comprises an algorithm to perform the following steps: (a) freeze a selected regenerative heat exchanger in a heat sink media cooling mode of operation while maintaining the other regenerative heat exchangers in their normal mode of operation; (b) read the measured temperature from the temperature measuring means and continue to freeze the selected regenerative heat exchanger in the heat sink media cooling mode of operation until the measured temperature is less than a predetermined value; (c) close off all flow into the selected regenerative heat exchanger to stop the flow of both the polluted and cleansed gases into and out of the selected regenerative heat exchanger; (d) start the flow of the cleaning fluid into the spray pipe of the selected regenerative heat exchanger to dislodge the deposited matter from the surface of the heat sink media within the selected regenerative heat exchanger; (e) stop the flow of the cleaning fluid into the spray pipe of the selected regenerative heat exchanger after a predetermined period of time; (f) operate the flow control means of the selected regenerative heat exchanger in the bed heating mode while monitoring the temperature measured by the temperature measuring means within the selected regenerative heat exchanger; and (g) revert the selected regenerative heat exchanger back into the normal mode of operation when the temperature measured within the heat sink media of the selected regenerative heat exchanger by the temperature measuring means of the selected regenerative heat exchanger reaches a predetermined level.

In yet another aspect of the present invention, a method of suppressing fires within a regenerative heat exchanger of a regenerative fume incinerator is disclosed. The regenerative heat exchanger contains regenerative heat sink media. The regenerative heat exchanger further has at least one spray pipe and at least one temperature measuring means installed within it. The spray pipe is connected to a source of water. The spray orifices on the spray pipe are directed towards the surface of the heat sink media within the regenerative heat exchanger. The method comprises the steps of (i) monitoring the temperature within the regenerative heat exchanger indicated by the temperature measuring means; and (ii) introducing the water into the spray pipe when the measured temperature reaches a pre-determined high level.

Other and further objects, advantages, and features of the present invention will be understood by reference to the following specification in conjunction with the annexed drawings, wherein like parts have been given like numbers.

DETAILED DESCRIPTION OF THE INVENTION

Figure 1:
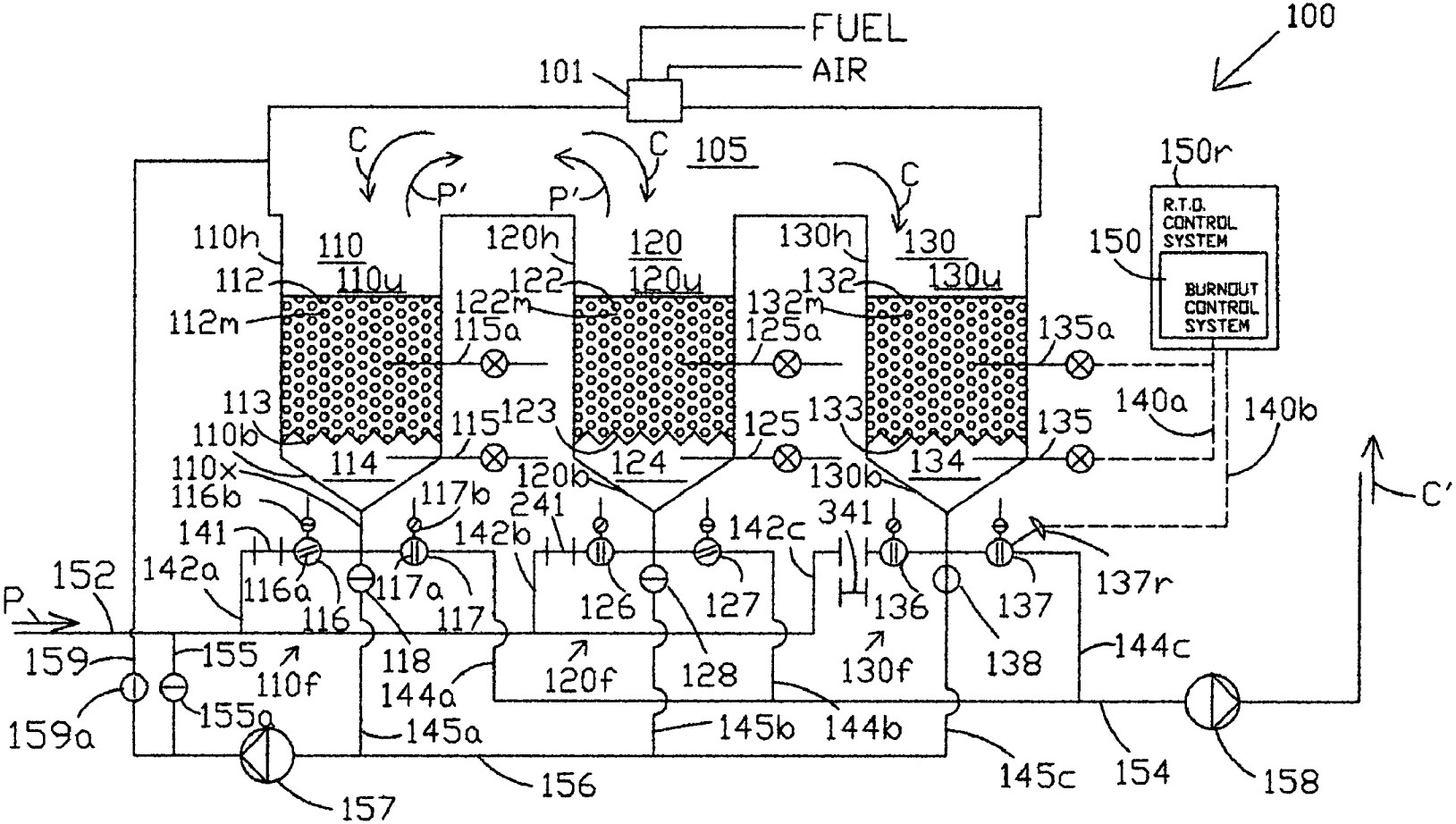
FIGURE-1 PRIOR ART
FIG. 1 is a schematic representation of a regenerative fume incinerator according to the prior art.

As defined herein, the term "inlet mode of operation" describes the mode of operation of the regenerative heat exchanger wherein the gas is introduced into the regenerative heat exchanger from the cold end of the regenerative heat exchanger. The inlet mode of operation occurs when (1) the cold polluted gas is introduced into the regenerative heat exchanger through the inlet damper (a "normal inlet mode of operation") or (2) a portion of the cooled cleansed gas is recycled back through a purge damper into the cold end of the regenerative heat exchanger to displace the residual polluted gas of the previous cycle into the combustion chamber (a "positive purge mode of operation").

Further, as defined herein, the term "outlet mode of operation" describes the mode of operation of the regenerative heat exchanger wherein the gas is introduced into the regenerative heat exchanger from the hot end of the regenerative heat exchanger. The outlet mode of operation occurs when (1) the hot cleansed gas flows from the hot end into the regenerative heat exchanger and then exits the cold end of the regenerative heat exchanger through the outlet damper (a "normal outlet mode of operation") or (2) a portion of the hot cleansed gas is drawn through the regenerative heat exchanger to displace the residual polluted gas through the purge damper in the cold end of the regenerative heat exchanger (a "negative purge mode of operation".)

Further, as defined herein, the term "purge mode of operation" describes the mode of operation of the regenerative heat exchanger wherein the residual polluted gas from the previous normal mode of operation is removed from the cold end of the regenerative heat exchanger. The residual polluted gas is removed either by (1) displacing it with hot cleansed gas from the combustion chamber during a negative purge mode of operation, as described above; or (2) displacing it with cooled cleansed gas from the regenerative fume incinerator exhaust stack during a positive purge mode of operation, as described above.

Further, as defined herein, a "heat sink media cooling mode of operation" occurs when the regenerative heat exchanger is in a normal inlet mode of operation or a positive purge mode of operation. In the heat sink media cooling mode of operation, the cold polluted gas or the relatively cooler cleansed gas cools the previously heated heat sink media.

Yet further, as defined herein, a "heat sink media heating mode of operation" occurs when the regenerative heat exchanger is in a normal outlet mode of operation or in a negative purge mode of operation. In the heat sink media heating mode of operation, the hot cleansed gas heats the heat sink media which was previously cooled. Yet further, as defined herein, a "normal without purge mode of operation" occurs when the regenerative heat exchanger alternately executes at least a normal inlet and a normal outlet mode of operation, each mode of operation being executed for a pre-determined period of time. In regenerative heat exchanger, which are equipped with purge systems, a "normal with purge mode of operation" occurs when the regenerative heat exchanger alternately executes at least a normal inlet mode of operation, a purge mode of operation, and a normal outlet mode of operation, each mode of operation being executed for a pre-determined period of time. As defined herein, a "normal mode of operation" includes either a normal without purge mode of operation or a normal with purge mode of operation as defined above.

Yet further, as defined herein, a "burn-out mode of operation" occurs when the regenerative heat exchanger is held in a heating mode of operation until the temperature of the heat sink media in the regenerative heat exchanger reaches a pre-determined high level, which is sufficient for the gasification of the deposited matter within the heat sink media.

The present invention can best be described with reference to the prior art shown in FIG. 1.

Figure 2:
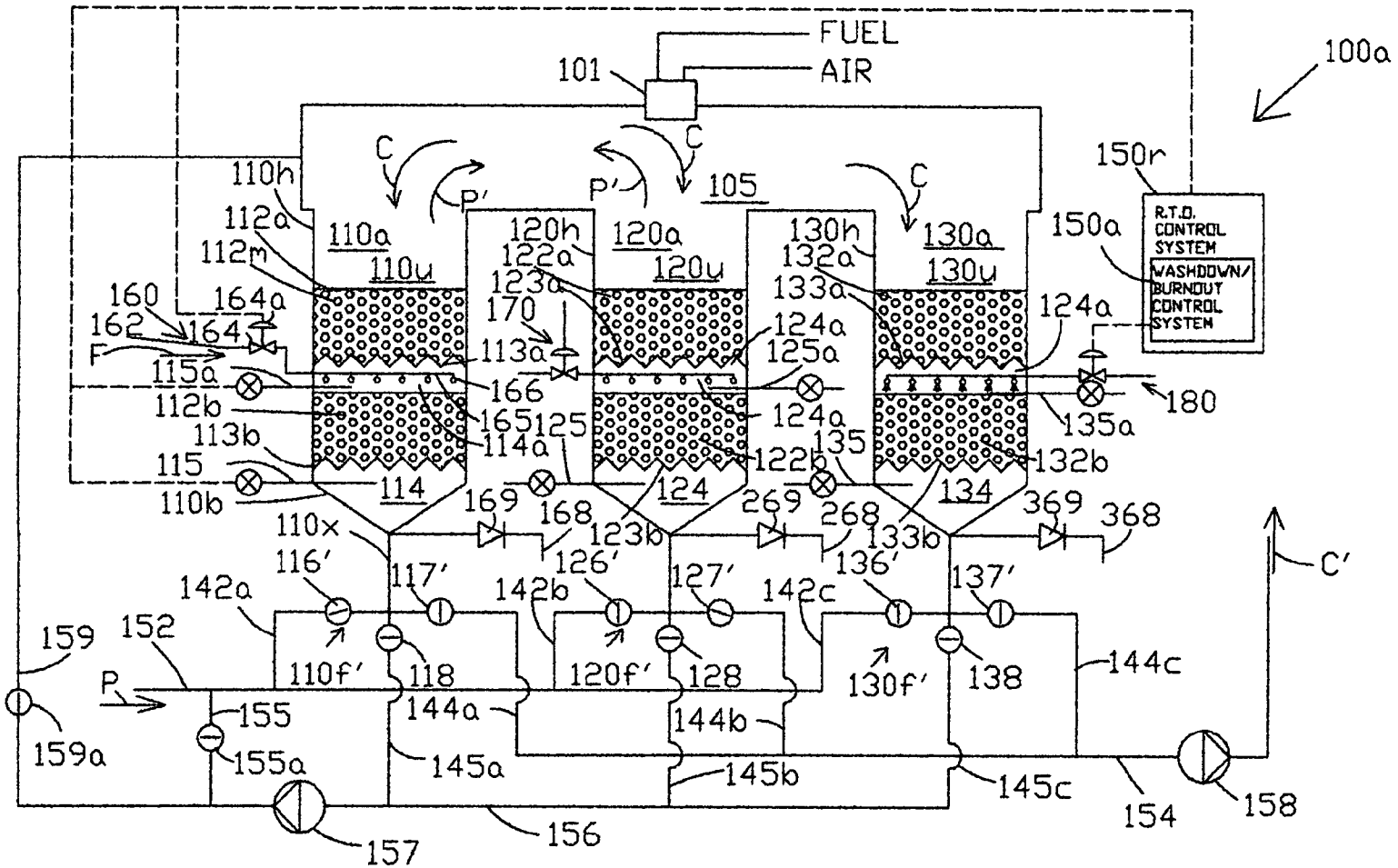
FIG. 2 is a schematic representation of a regenerative fume incinerator according to the present invention.

FIG. 1 shows a prior art regenerative thermal oxidizer with three regenerative heat exchangers and with a burn-out mode of operation according to the prior art. The design, construction, and operation of such regenerative thermal oxidizers is well known in the art and is described in detail in the aforementioned US patents to York and to Plejdrup et al. FIG. 2 shows a regenerative thermal oxidizer which is modified to provide the regenerative thermal oxidizer of the present invention. While a regenerative thermal oxidizer with three regenerative heat exchangers is shown as an example in this description of the invention, the invention can also be practiced with a regenerative thermal oxidizer having more than three regenerative heat exchangers, as will be described later. Further, while an regenerative thermal oxidizer is shown as an example in FIGS. 1 and 2, the invention can also be practiced with other regenerative fume incinerators such as regenerative catalytic oxidizers and thermal catalytic oxidizers.

Briefly, FIG. 1 shows a regenerative thermal oxidizer 100 comprising a combustion chamber 105, a first regenerative heat exchanger 110, a second regenerative heat exchanger 120, and a third regenerative heat exchanger 130. Combustion chamber 105 is equipped with a means, such as gas or fuel-oil burner system 101, to raise and maintain the temperature of the polluted gas within combustion chamber 105 to a range between 1,200 to 2,000 degrees F. to oxidize the pollutants in the polluted gas processed by regenerative thermal oxidizer 100. In FIG. 1, "P" denotes the cold polluted gas, "P'" denotes the preheated polluted gas, "C" denotes the hot cleansed gas, and "C'" denotes the cooled cleansed gas.

Regenerative heat exchanger 110 has a housing 110*h* with a closed bottom 110*b* and a open upper end 110*u* which is in fluid communication with combustion chamber 105. Regenerative heat exchanger 110 further comprises a heat sink media support grid 113 on which is located a heat sink media bed 112.

Heat sink media bed 112 comprises a heat sink media 112*m*. Heat sink media 112*m* could be random packing made of material such as ceramic stoneware or porcelain or metal or any other material which has suitable thermal properties for use in a regenerative thermal oxidizer. Standard commercially available random packing include saddles, berl rings, raschig rings, intallox saddles, or any other commercially available column packing. Random packing could also include proprietary designs such as the Ty-Pak™ media that are available from US suppliers such as Norton Process Industries, Koch Industries, American Ceramic and Clay Co., and others. Alternatively, heat sink media 112*m* could be structured media made of ceramic or porcelain or metal or any other material which has suitable thermal properties. Structured heat sink media is commercially available as extruded blocks from US suppliers such as Norton Process Industries or as fabricated blocks under the trade-names Flexaramic™ from Koch Industries and Multilayered Monolith Media (MLM™) from Lantec Products Inc.

Heat sink media support grid 113 is located near the cold end of regenerative heat exchanger 110 so that a flow volume 114 is created under heat sink media support grid 113 between bottom end 110*b* and heat sink media support grid 113. As described below, a flow control means 110*f* is connected to flow volume 114 to bring polluted gas P into regenerative heat exchanger 110 or to remove the cooled cleansed gas C' from regenerative heat exchanger 110. A thermocouple or other temperature measuring means 115 which measures the temperature in volume 114 during normal and burn-out conditions is located in volume 114.

As shown in FIG. 1, regenerative heat exchangers 120 and 130 are constructed similar to regenerative heat exchanger 110. For example, regenerative heat exchanger 120 also has a housing 120*h*, a heat sink media support grid 123, a heat sink media bed 122 comprised of heat sink media 122*m*, and volume 124 between bottom end 120*b* and heat sink media support grid 123. The open hot ends 110*u*, 120*u*, and 130*u* of regenerative heat exchangers 110, 120, and 130 respectively are connected to combustion chamber 105 so that preheated polluted gas P' can flow into combustion chamber 105 from regenerative heat exchangers 110, 120, and 130. Similarly, hot cleansed gas C can flow from combustion chamber 105 into regenerative heat exchangers 110, 120, and 130 through open ends 110*u*, 120*u*, and 130*u* respectively. Thermocouples or other temperature measuring means 125 and 135 are also located under heat sink media support grids 123 and 133 of regenerative heat exchangers 120 and 130 respectively.

Temperature measuring means 115, 125 and 135 provide temperature level signals to Burnout Control System (BCS) 150, which may be separate from or may be a part of the overall regenerative thermal oxidizer control system 150*r*. For example, the regenerative thermal oxidizer control system may be a Programmable Logic Controller (PLC) and BCS 150 may be computer code or a sub-program or a subroutine within the regenerative thermal oxidizer main control program which is loaded in the PLC. As described in previous referenced patent to Plejdrup et al., the computer code would execute an algorithm to burn-out the regenerative heat exchanger bed to remove condensed organic matter deposited therein.

A flow control means (FCM) 110*f* is connected to regenerative heat exchanger 110 as stated above. Flow control means 110*f* comprises a cross-shaped duct 110*x*, an inlet damper 116, an outlet damper 117, and a purge damper 118. Duct section 110*x* communicates at its first open end to flow volume 114 and at its other three open ends to inlet damper 116, outlet damper 117, and purge damper 118 respectively. As shown in FIG. 1, inlet damper 116 and outlet damper 117 are of the block-and-bleed butterfly type of design while purge damper 118 is a single-bladed butterfly damper. Block-and-bleed butterfly dampers are described in the sales literature of US damper manufacturers such as Effox Inc, Bachmann Dampers Inc., and others. The use of block-and-bleed dampers is mandated within the USA by the Factory Mutual Insurance Co. for isolating an regenerative fume incinerator from the process when the regenerative heat exchanger bed is being burnt-out of its deposited matter.

As described in the previously referred patent to Plejdrup et al., during the burn-out mode of operation, the average temperature of the heat sink media in the regenerative heat exchanger is raised to a temperature which is high enough (generally in the range of 400 to 800 degrees F.) to gasify the organic matter that may have been deposited on the surfaces of the heat sink media during the normal operation of the regenerative thermal oxidizer. As used herein, the term "gasify" means to volatilize the low-boiling combustible matter or to fully or partially oxidized (pyrolize) the combustible matter or otherwise convert the organic matter to a gaseous form by either chemical reaction or phase change means. The gaseous matter is then swept away by the hot gas to provide relatively cleaner heat transfer surfaces in the heat sink media. Alternately, non-gasifiable matter, such as inorganic salts, is left behind. As described in the Noble method, this non-gasifiable deposited matter is then washed down with a cleaning fluid.

As shown in FIG. 1, block-and-bleed damper 116 comprises two major damper blades 116*a* with an intermediate space between them. When the major damper blades 116*a* are in a closed position, the closed intermediate space between them is evacuated by means of an open single-bladed bleed damper 116*b*. The bleed damper 116*b* prevents the leakage of polluted gas P on the first side of the first blade into cooled cleansed gas C' on the second side of the second blade to increase the overall pollution cleaning performance of regenerative thermal oxidizer 100. Outlet damper 117 is constructed similar to inlet damper 116 with double-blades 117*a* and a single-bladed bleed damper 117*b*. As commonly practiced in the art, the inlet, outlet, purge dampers, and bleed dampers are operated by commonly available pneumatic or hydraulic or electric actuators. A representative example wherein actuator 137*r* of damper 137 is controlled by regenerative thermal oxidizer control system 150*r* is shown in FIG. 1. This example applies to all dampers of regenerative thermal oxidizer 100.

As shown in FIG. 1, similar flow control means 120*f* and 130*f* are connected to bottom ends 120*b* and 130*b* of regenerative heat exchangers 120 and 130 respectively to bring polluted gas P to and to remove cooled cleansed gas C' from regenerative heat exchangers 120 and 130.

As generally described in the previously referenced patent to Plejdrup et al., polluted gas P from the process is conveyed to regenerative heat exchangers 110, 120, and 130 through inlet duct 152. A branch duct 142*a* connects inlet duct 152 to damper 116 through a removable spool-piece of duct 141. The use of the removable spool-piece is also mandated by the Factory Mutual Insurance Co. Removable spool-piece 141 isolates regenerative thermal oxidizer 100 from the process when the condensed organic material in the heat sink media of the regenerative heat exchanger beds is being gasified during the burn-out mode of operation of regenerative thermal oxidizer 100. Similar branch ducts 142*b* and 142*c* are provided in parallel to branch duct 142*a*. Branch ducts 142*b* and 142*c* connect inlet duct 152 to damper 126 of flow control means 120*f* and damper 136 of flow control means 130*f* through spool-pieces 241 and 341 (shown removed in FIG. 1) respectively. Similarly, outlet dampers 117, 127, and 137 are connected to outlet duct 154 through mutually parallel branches 144*a*, 144*b*, and 144*c* respectively. Outlet duct 154 is connected to induced draft fan 158 which evacuates cooled cleansed gas C' to atmosphere or to a downstream process.

In a similar manner, purge dampers 118, 128, and 138 are connected to purge recycle duct 156 through mutually parallel branches 145*a*, 145*b*, and 145*c* respectively. Purge recycle duct 156 is connected to inlet duct 152 through an interconnecting branch duct 155 which, as described in the previously referenced US patent to York, recycles residual polluted gas P from volumes 114, 124 and 134 under heat sink media beds 112, 122, and 132 when the selected bed is in a negative purge mode of operation. The negative purge mode of operation of regenerative thermal oxidizers is described in detail in the previously referenced patent to York. A purge recycle fan 157 is located in purge recycle duct 156 to assist in evacuating the purged gas. Dampers 155*a* and 159*a* are located in ducts 155 and 159 respectively to control the amount of purged air that is recycled to the inlet duct 152 and to the combustion chamber 105 respectively.

During the normal mode of operation of regenerative thermal oxidizer 100, the inlet, outlet and purge dampers are opened and closed as generally described in the previously referenced patent to York. When a burnout is required to clean the bed of deposited gasifiable matter, the regenerative thermal oxidizer is operated according to the procedure generally described in the previously referenced patent to Plejdrup et al. For example, in regenerative thermal oxidizer 100, regenerative heat exchanger 130 is shown to be in the burn-out mode of operation. Thus, double-blades 136*a* of inlet damper 136 are closed, bleed damper 136*b* is opened and spool piece 341 is manually removed to isolate the hot zone in space 134 under heat sink media support grid 133 from polluted gas P. If there are no environmental concerns for exhausting a smoky plume to the atmosphere, then purge damper 138 is closed and outlet damper 137 is opened to exhaust the smoky gasified products of the burn-out to the atmosphere through blower 158. Gasification of the deposited gasifiable matter in heat sink media bed 132 is effected by allowing hot cleansed gas C to flow from combustion chamber 105 into and through heat sink media bed 132 for an extended period of time. The continuous flow of cleansed hot gas C through heat sink media bed 132 raises the temperature of heat sink media 132*m*. This increase in temperature causes gasification of the gasifiable matter which was deposited on heat sink media 132*m*. The burn-out mode of operation is continued for a period of time as required to adequately gasify the deposited gasifiable matter from the surfaces of heat sink media 132*m*. In the meanwhile, regenerative heat exchangers 110 and 120 are operated in a normal without purge mode of operation.

Alternately, if a smokeless burnout is required, outlet damper 137 is also closed and purge damper 138 is opened and cleansed hot gas C is allowed to pass through heat sink media bed 132 of regenerative heat exchanger 130 for an extended period of time. The smoky gasified products of the burn-out are recycled back to inlet duct 152 for purification in combustion chamber 105 through open damper 155*a* in duct 155. Alternatively, as shown in FIG. 1, the smoky gasified products of the burnout are recycled directly back to combustion chamber 105 through open damper 159*a* in duct 159. This burn-out mode of operation is described in detail in Plejdrup et al.

When the cooled cleansed gas temperature in volume 134 reaches a preset temperature, generally in the range of 400 to 1,000 degrees F., the burn-out mode of operation for regenerative heat exchanger 130 is concluded. Outlet damper 137 and purge damper 138 are closed. Spool-piece 341 is reattached between branch 142*c* and inlet damper 136. Inlet damper 136 is then re-opened. Cold polluted gas P is again passed into regenerative heat exchanger 130 through duct 142*c*. The open position of inlet damper 136 is maintained for a period of time as required to cool heat sink media 132*m* in regenerative heat exchanger 130 to a pre-determined temperature. This concludes the burn-out mode of operation for regenerative heat exchanger 130.

The burn-out mode of operation described above for regenerative heat exchanger 130 can be conducted, randomly or in sequence, for each of the remaining regenerative heat exchangers 110 and 120. While the burn-out mode of operation, described above, is generally effective in cleaning the heat sink media of deposited matter which can be gasified by high temperature, it is not very effective in cleaning the heat sink media of deposited non-gasifiable matter. Furthermore, particulate matter that may be deposited within the heat sink media may consist of organic and inorganic matter. Yet furthermore, combustible particulate matter such as wood sawdust, may gasify leaving behind an ash which consists mainly of non-gasifiable inorganic matter. For example, it is well know that wood contains alkalis such as sodium. During the burn-out process, the alkalis get converted to alkali salts which remain on the surface of the heat sink media after the burn-out and affect the thermal performance and pressure drop characteristic of the regenerative thermal oxidizer heat sink media bed. The alkali salts can also attack the ceramic material of the heat sink media and vitiate its performance enough to require periodic replacement, thereby increasing the operating cost of the regenerative thermal oxidizer.

The present invention described herein and shown in FIG. 2 overcomes these disadvantages. It allows for the automatic or manually selected on-line gasification of the deposited gasifiable matter as well as the on-line washing out of the remaining non-gasifiable matter in the heat sink media. Further, it economically simplifies the system by eliminating the need for the insurance company mandated block-and-bleed dampers and the duct spool-pieces to isolate the hot zones in the regenerative heat exchangers from the process during the burn-out mode of operation. Yet further, it simplifies the burn-out operation because manual removal of the spool-pieces is not required during the burn-out process of the present invention. Therefore, shutdown of the regenerative thermal oxidizer is not required and loss of production does not occur. As a further advantage, it provides automatic fire-suppression in the event that the combustible deposited matter within the regenerative heat exchanger bed auto-ignites during normal operation or burn-out operation of the regenerative fume incinerator.

The present invention is best understood by the following description, which highlights the major differences between the prior art regenerative thermal oxidizer 100 shown in FIG. 1 and the regenerative thermal oxidizer 100*a* of the present invention as shown in FIG. 2. For simplicity, the same reference figures are used in both figures to denote features which are common to both the prior art regenerative thermal oxidizer 100 and regenerative thermal oxidizer 100*a*.

Heat Sink Media Bed Construction:

Heat sink media beds 112, 122, and 132 of regenerative heat exchangers 110*a*, 120*a*, and 130*a* respectively in regenerative thermal oxidizer 100*a* of the present invention are modified as shown in FIG. 2

Using regenerative heat exchanger 110*a* as an example, heat sink media bed 112 of regenerative heat exchanger 110*a* in FIG. 2 is shown divided into two sections. Upper heat sink media bed section 112*a* is supported by an upper heat sink media support grid 113*a* and lower heat sink media bed section 112*b* is supported by the lower heat sink media support grid 113*b*. Upper heat sink media support grid 113*a* can be independently supported from housing 110*h* of regenerative heat exchanger 110*a*. Alternatively, upper heat sink media support grid 113*a* can rest on and be supported by the upper surface of lower bed section 112*b*. The relative heights of heat sink media bed sections 112*a* and 112*b* is determined by the temperature profile in the overall bed. Generally, the height of lower heat sink media bed section 112*b* can be about one-eight to three-quarter of the total height of bed 112 in FIG. 1.

Similarly, heat sink media bed 122 is divided into bed sections 122*a* and 122*b*, which are supported on heat sink media support grids 123*a* and 123*b* respectively.

Also, heat sink media bed 132 is divided into sections 132*a* and 132*b*, which are supported on heat sink media support grids 133*a* and 133*b* respectively.

Upper heat sink media bed section 112*a* and lower heat sink media bed section 112*b* are located such that a free volume 114*a* is created between the upper end of lower heat sink media bed section 112*b* and heat sink media support grid 113*a* which supports upper heat sink media bed section 112*a*. Similar free volumes 124*a* and 134*a* are created in regenerative heat exchangers 120*a* and 130*a* respectively.

Addition of Cleaning-Fluid Spray System:

Cleaning-fluid spray systems are provided in each of modified regenerative heat exchangers 110*a*, 120*a*, and 130*a* respectivly in regenerative thermal oxidizer 100*a* of the present invention. Cleaning-fluid "F" can be any suitable fluid such as water, steam, or compressed air.

Figure 3:
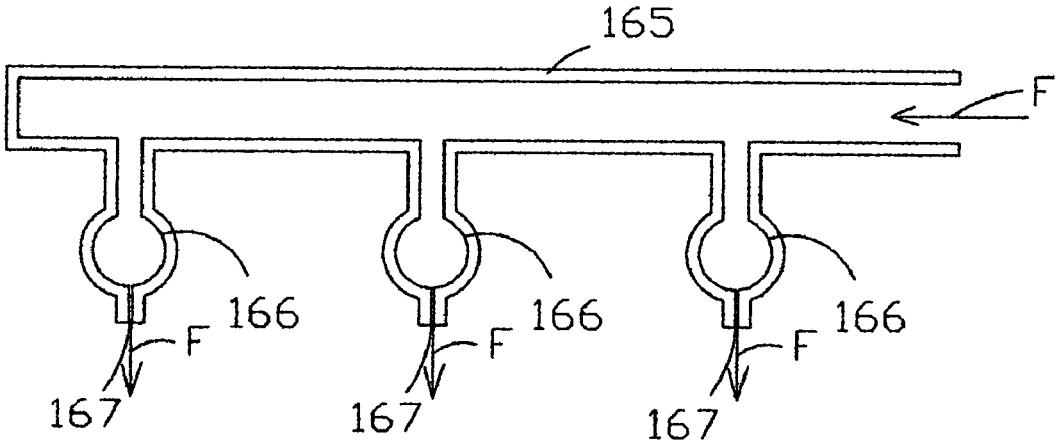
FIG. 3 is a general representation of the details of the spray pipes of the deposited matter removal means, which is located in the regenerative heat exchanger of the regenerative fume incinerator of the present invention.

As an example, the following detailed description is given for spray system 160 in regenerative heat exchanger 110*a* as shown in FIG. 2. Spray system 160 comprises a plurality of distribution pipes 166 which are located within free volume 114*a*. As shown in FIG. 3, spray orifices such as spray nozzles 167 are provided on each distribution pipe 166. Alternately, the spray orifices could be spray holes which are drilled at suitable locations on each distribution pipe. As yet another alternative, commercially available atomizers could also be used to distribute cleaning fluid F from the spray-pipe. Nozzles 167 are aimed at the lower heat sink media bed section 112*b*. The number of pipes 166 and nozzles 167 is selected to generally provide complete coverage of the horizontal cross-section of heat sink media bed lower section 112*b* so that cleaning-fluid F sweeps away substantially all of the deposited matter which coats the heat transfer surfaces in heat sink media bed lower section 112*b*.

Each distribution pipe 166 is connected to a header pipe 165 which extends through housing 110*h* of regenerative heat exchanger 110*a*. The external end of header pipe 165 is connected to the outlet side of a flow control valve 164, which controls the flow of cleaning-fluid F to header pipe 165. A cleaning-fluid supply pipe 162 is connected to the inlet side of flow control valve 164 to provide cleaning-fluid F for cleaning the bed lower section 112*b*. An actuator 164*a* is connected to valve 164 to provide the motive force for opening or closing valve 164. Actuator 164*a* can be an electric or pneumatic or hydraulic actuator as described previously herein. These actuators are commercially available from US suppliers such as Parker-Hannifin, Honeywell, Barber-Colman, Foxboro-Jordan and others.

A Wash-down/Burn-out Control System (WBCS) 150*a*, which will be described below, controls actuator 164*a*. Wash-down/Burn-out Control System 150*a* is similar to BCS 150 in FIG. 1 but has the added functionality of being able to control the operation of actuator 164*a* as required to wash-down heat sink media bed lower section 112*b*. A thermocouple or other suitable temperature measuring means 115*a* is also located in free space 114*a*. Temperature measuring means 115*a* is connected to Wash-down/Burn-out Control System 150*a* and measures the gas temperature within free space 114*a* to initiate or end the wash-out mode of operation in accordance with a control algorithm within Wash-down/Burn-out Control System 150*a*. It is not necessary that free space 114*a* be an open volume in between upper bed section 112*a* and lower bed sections 112*b*. For example, the two bed sections could be separated by the location of the spray-pipes 166 only. In such a configuration, the free space 114*a* would be the volume around spray-pipes 166 around which the gas temperature is measured by temperature measuring means 115*a*.

The cleaning-fluid spray system 160 is also capable of being operated as a fire suppression system by using water as the spray-fluid. This feature is initiated during the normal or burn-out modes of operation if the temperature measured by thermocouple 115 in zone 114 reaches a pre-determined high value, generally above 600 degrees F. When this temperature is reached or exceeded, an alarm can sound and water can be sprayed on the lower bed section 112*b* to extinguish the fire and prevent further damage to regenerative thermal oxidizer 100*a*.

Similar cleaning-fluid spray systems 170 and 180 are also located within regenerative heat exchangers 120*a* and 130*a*. The construction and operation of spray systems 170 and 180 is similar to that described above for spray system 160.

Simplification of Inlet and Outlet Dampers:

Because of the added protection provided by the fire suppression operating mode (as described above) of spray system 160, insurance companies do not mandate the use of block-and-bleed dampers on regenerative heat exchanger beds 110*a*, 120*a*, and 130*a* for regenerative thermal oxidizer 100*a* of the present invention. Thus dampers 116' and 117' in flow control means 110*f'* on regenerative heat exchanger 110*a* of the present invention can be simple single-bladed dampers. Similarly, dampers 126' and 127' in flow control means 120*f'* on bed 120*a* and dampers 136' and 137' in flow control means 130*f'* on bed 130*a* can also be single-bladed dampers. The use of single-bladed dampers greatly reduces the cost and complexity of regenerative thermal oxidizer 100*a* of the present invention compared to prior art regenerative thermal oxidizer 100.

Elimination of Spool-Pieces on Inlet Duct Branches:

As described above, cleaning-fluid spray systems 160, 170 and 180 on regenerative heat exchangers 110*a*, 120*a*, and 130*a* respectively are also capable of being operated as fire-suppression systems. Therefore, insurance companies do not require spool-pieces to be installed in inlet duct branches 142*a*, 142*b*, and 142*c* of regenerative heat exchangers 110*a*, 120*a*, and 130*a* respectively in regenerative thermal oxidizer 100*a* of the present invention to isolate it from the process during the burn-out operation. Thus spool-pieces 141, 241, and 241 which were required for prior art regenerative thermal oxidizer 100 shown in FIG. 1 are not required for regenerative thermal oxidizer 100*a* of the present invention shown in FIG. 2.

Drains on Regenerative Thermal Oxidizer Bed Floors:

If cleaning fluid F is a liquid or steam, a drain 168 is provided on the floor of regenerative heat exchanger 110*a* to remove liquid cleaning-fluid or condensate from the steam, which is sprayed by the cleaning-fluid spray system 160 into regenerative heat exchanger 110*a*. Drain 168 is not required if compressed air or some other non-condensing gas is used as the cleaning-fluid. Drain 168 also removes water that may be used to suppress fires in regenerative heat exchanger 110*a* as described above. A one-way check valve 169 is provided in drain 168 to prevent outside air from entering regenerative heat exchanger 110*a* during normal operation of the regenerative heat exchanger 110*a*. Instead of a one-way check valve, a suitable barometric leg or a P-trap could also be used to achieve the same result.

Similar drains 268 and 368 with check valves 269 and 369 are provided on regenerative heat exchangers 120*a* and 130*a* respectively in regenerative thermal oxidizer 100*a*.

Figure 4:
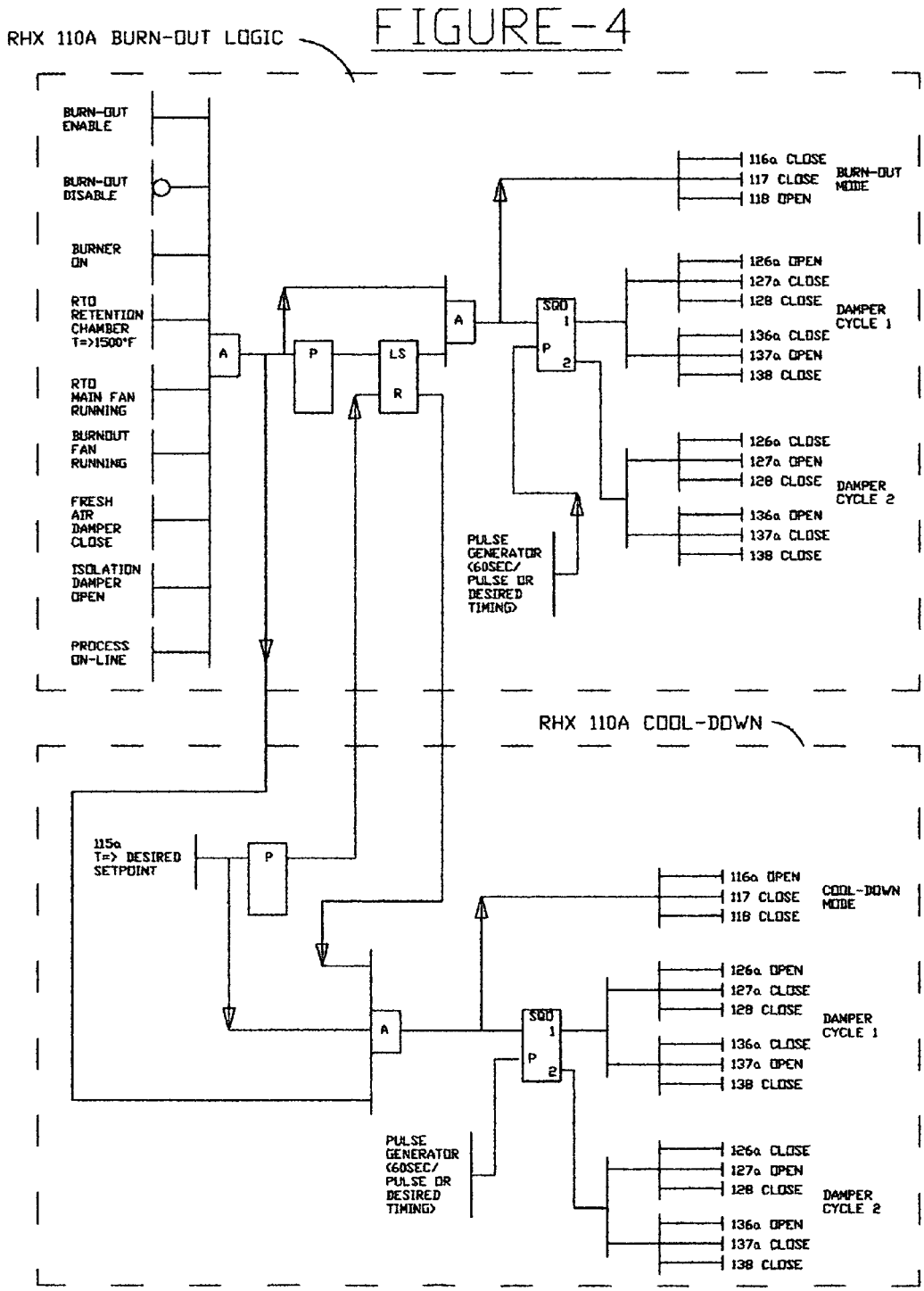
FIG. 4 is a representation of the control logic of the on-line burn-out control system in the regenerative fume incinerator control system of the present invention.

The foregoing paragraphs described the physical changes in regenerative thermal oxidizer 100*a* of the present invention relative to prior art regenerative thermal oxidizer 100. The following paragraphs describe the burn-out and wash-down modes of operation of regenerative thermal oxidizer 100*a* of the present invention:

On-Line Burn-out:

With reference to FIG. 2, on-line burn-out is provided on regenerative thermal oxidizer system 100*a* such that the heat sink media beds in individual regenerative heat exchangers 110*a*, 120*a*, or 130*a* are burned out randomly (a "random burn-out"). Alternatively, the initiation of the burn-out cycle can automatically burn-out the heat sink media in all of the regenerative heat exchangers 110*a*, 120*a*, and 130*a* in sequence (a "sequential burn-out"). The control-logic for the burn-out mode of operation is shown in attached FIG. 4 and is as follows:

1) The burn-out cycle is initiated from the Man-Machine Interface (MMI) of the regenerative thermal oxidizer Control System 150*r* to instruct Wash-down/Burn-out Control System 150*a* to burn-out the heat sink media bed in one of regenerative heat exchangers 110*a*, 120*a*, or 130*a*. As an example, it is assumed herein that regenerative heat exchanger 110*a* is selected for burn-out.

2) On completion of the normal mode of operation for regenerative heat exchanger 110*a* as described previously with respect to regenerative thermal oxidizer 100 in FIG. 1, regenerative heat exchanger 110*a* is frozen in a heat sink media heating mode of operation.

3) The overall regenerative thermal oxidizer cycle then automatically converts from a normal with purge mode of operation to a normal without purge mode of operation as described previously with respect to regenerative thermal oxidizer 100 in FIG. 1. In this example, regenerative heat exchangers 120*a* and 130*a* operate in a normal without purge mode of operation while regenerative heat exchanger 110*a* is frozen in a heat sink media heating mode of operation. Thus regenerative heat exchangers 120*a* and 130*a* alternately operate in a normal inlet and a normal outlet mode of operation.

4) Regenerative heat exchanger 110*a* remains locked in the heat sink media heating mode of operation until the pre-set burnout temperature is reached as indicated by thermocouple 115 located in volume 114 of regenerative heat exchanger 110*a*. The pre-set burn-out temperature is generally in the range of 400 to 1,000 degrees F. but is normally set at 600 degrees F. for adequate burn-out in most regenerative thermal oxidizers.

5) Once the pre-set burn-out temperature is reached, heat sink media 112*m* in lower bed section 112*b* of regenerative heat exchanger 110*a* is substantially cleansed. Wash-down/Burn-out Control System 150*a* now operates newly cleansed regenerative heat exchanger 110*a* in a heat sink media cooling mode of operation for cool-down of heat sink media bed sections 112*a* and 112*b* to normal operating average temperatures.

6) Cool-down of regenerative heat exchanger 110*a* is considered complete when temperature measuring means 115*a* in free space 114*a* reaches the average equivalent temperature measured by temperature measuring means 125*a* and 135*a* in regenerative heat exchangers 120*a* and 130*a*.

7) If the sequential burn-out mode of operation was selected, Wash-down/Burn-out Control System 150*a* automatically initiates the burn-out of the next regenerative heat exchanger, for example regenerative heat exchanger 120*a* followed by regenerative heat exchanger 130*a*. Thus the lower heat sink media bed sections 122*b* and 132*b* in regenerative heat exchangers 120*a* and 130*a* respectively are sequentially cleansed.

8) On completion of the random or sequential burn-out of any or all of regenerative heat exchangers 110*a*, 120*a*, and 130*a*, Wash-down/Burn-out Control System 150*a* operates regenerative thermal oxidizer 100*a* in a normal with purge mode of operation.

In a random burn-out mode of operation, Wash-down/Burn-out Control System 150*a* will continue operation of regenerative thermal oxidizer 110*a* in the normal mode of operation. In a sequential burn-out mode of operation, Wash-down/Burn-out Control System 150*a* automatically advances the burn-out operation to the remaining regenerative heat exchanger beds until all regenerative heat exchanger beds are cleaned. Thus in FIG. 2, Wash-down/Burn-out Control System 150*a* will, in the sequential burn-out mode, automatically repeat steps (1) to (8) in regenerative heat exchangers 120*a* and 130*a*.

As previously described, cleaning fluid spray system 160 can also be used as a water-deluge system in case of a fire in regenerative heat exchangers 110*a* as detected by temperature measuring means 115. Similarly, cleaning fluid spray systems 170 and 180 can be used for fire-suppression in regenerative heat exchangers 120*a* and 130*a* respectively. The water-deluge system is activated on a high, high temperature limit at which time regenerative thermal oxidizer 100*a* is shut down and isolated from the process, and flow control means 110*f*', 120*f*' and 130*f*' are all positioned to shut-off all flow to and from regenerative heat exchangers 110*a*, 120*a*, and 130*a*. The water-deluge system is then switched on in the regenerative heat exchanger, which shows a high outlet temperature. Depending on the flammability characteristics of the deposited matter which is being gasified, the high, high temperature limit could be set at a value between 600 to 1,000 degrees F.

Figure 5:
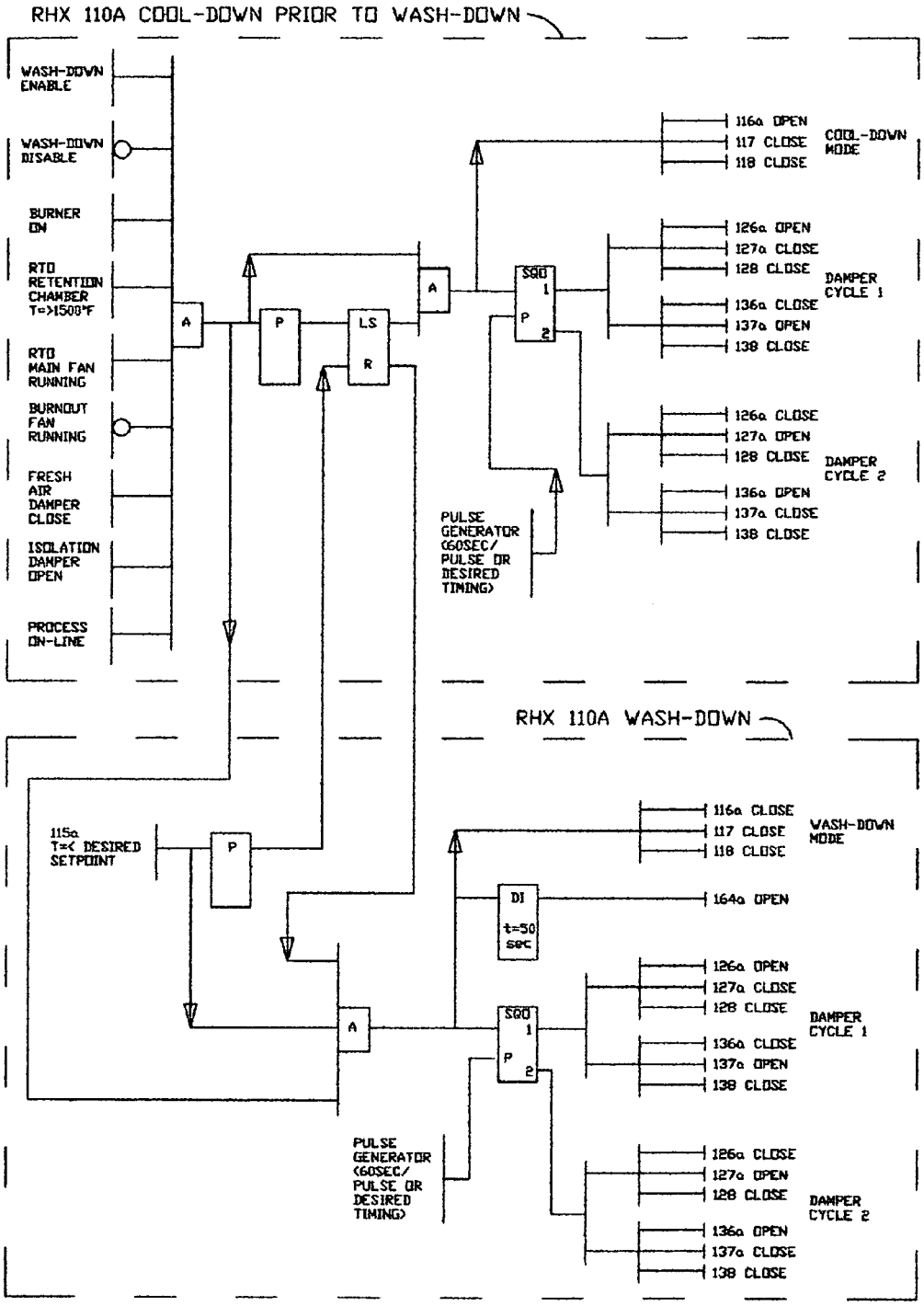
FIG. 5 is a representation of the control logic of the on-line wash-down control system in the regenerative fume incinerator control system of the present invention.

On-Line Wash-down System:

The following procedure is used to wash-down the deposited matter from the heat-transfer surfaces of lower heat sink media bed sections 112*b*, 122*b*, and 132*b* in regenerative heat exchangers 110*a*, 120*a*, and 130*a*. As shown in the control-logic diagram of FIG. 5, the wash-down can be initiated manually or automatically after the burn-out cycle described above is completed.

1) The wash-down cycle is initiated from the Man-Machine Interface (MMI) of regenerative thermal oxidizer Control System 150*r* to instruct Wash-down/Burn-out Control System 150*a* to wash-down the heat sink media in one of regenerative heat exchangers 110*a*, 120*a*, or 130*a* (a "random wash-down"). Alternately, Wash-down/Burn-out Control System 150*a* can automatically sequence the wash-down (a "sequential wash-down") through each of regenerative heat exchangers 110*a*, 120*a*, and 130*a* respectively. As an example, it is assumed that regenerative heat exchanger 110*a* is selected for wash-down.

2) When regenerative heat exchanger 110*a* reaches the end of its inlet mode of operation, regenerative thermal oxidizer Control System 150*r* leaves open inlet damper 116' for cool-down of the heat sink media in regenerative heat exchanger 110*a*.

3) Wash-down/Burn-out Control System 150*a* then automatically converts the operation of regenerative thermal oxidizer 100*a* from a normal with purge mode of operation to a normal without purge mode of operation as described previously with respect to regenerative thermal oxidizer 100 in FIG. 1. Thus in this example, regenerative heat exchangers 120*a* and 130*a* operate in a normal without purge mode of operation while regenerative heat exchanger 110*a* is frozen in the inlet mode of operation as described above.

4) Regenerative thermal oxidizer bed 110*a* is maintained in the inlet mode of operation until thermocouple 115*a* measures a pre-set temperature, which is generally selected to a value of less than 500 degrees F. In most cases, it is contemplated that the pre-set temperature would be in the range of 200 to 250 degrees F. This preset temperature is selected to prevent thermal shock to the hot heat sink media by the impact of relatively colder cleaning fluid F.

5) Once this pre-set temperature is reached, Wash-down/Burn-out Control System 150*a* closes inlet valve 116*a* on regenerative heat exchanger 110*a*. Wash-down/Burn-out Control System 150*a* then sends a signal to actuator 164*a* to open cleaning-fluid flow valve 164 to enable the flow of cleaning-fluid F over heat sink media 112*m* in heat sink media bed lower section 112*b* of regenerative heat exchanger 110*a*.

6) Heat sink media bed lower section 112*b* is washed down for a pre-determined, operator-selectable period of time. Generally, the total time for wash-down of a single regenerative heat exchanger bed will be in the range of 5 to 60 minutes depending on the amount of and stickiness of the deposited matter within the lower heat sink media bed section. If a liquid cleaning-fluid is used, the dirty cleaning-fluid is drained from regenerative heat exchanger 110*a* through drain 168. The wash-down mode of operation is ended when the drained cleaning-fluid is relatively clean and free of contaminants. On completion of wash-down of regenerative heat exchanger 110*a*, cleaning-fluid flow valve 164*a* is closed by Wash-down/Burn-out Control System 150*a*. Though not necessary, a washed regenerative heat exchanger is generally allowed to drain for a period of about 5-30 minutes to substantially remove the residual liquid cleaning fluid from the washed heat sink media bed section. This step is not required if a gaseous cleaning-fluid such as compressed air is used to dislodge the deposits from the surface of the heat sink media.

7) After completion of draining, if required, Wash-down/Burn-out Control System 150*a* operates regenerative heat exchanger 110*a* in a heat sink media heating mode of operation.

8) Regenerative heat exchanger 110*a* remains in a heat sink media heating mode of operation until temperature measuring means 115*a* reaches a pre-determined temperature. As an example, the pre-determined temperature could be a previously determined value or it could a calculated value. For example, it could be equal to the average temperature measured by temperature measuring means 125*a* and 135*a* within regenerative heat exchangers 120*a* and 130*a*. Once this pre-determined temperature is reached, Wash-down/Burn-out Control System 150*a* returns regenerative thermal oxidizer 100*a* to a normal with purge mode of operation.

The above wash-down cycle (steps 1 to 8 above) is then repeated for remaining regenerative heat exchangers 120*a* and 130*a* as required.

It should be noted that a regenerative thermal oxidizer with three regenerative heat exchangers has been described above only as an example of a regenerative thermal oxidizer system, which incorporates the inventive features of the claimed invention. It will be obvious to one of ordinary skill in the art that the invention can be practiced with other regenerative fume incinerator s such as regenerative catalytic oxidizers and thermal catalytic oxidizers also. It will be also obvious to one of ordinary skill in the art that the invention can be practiced with regenerative fume incinerators equipped with any number of regenerative heat exchangers greater than three.

As examples, Table-1 shows the possible operating combinations with regenerative fume incinerators having different numbers of beds.

TABLE 1

| No of RHXs in regenerative fume incinerator | Normal operation of RHXs | Operation of RHXs during clean-out |
|---|---|---|
| 4 | 2 RHXs in normal inlet mode<br>2 RHXs in normal outlet mode | 2 RHXs in normal inlet mode<br>1 RHX in normal outlet mode<br>1 RHX in burn-out/wash-down mode |
| 4 | 2 RHXs in normal inlet mode<br>2 RHXs in normal outlet mode | 1 RHX in normal inlet mode<br>2 RHXs in normal outlet mode<br>1 RHX in burn-out/wash-down mode |
| 5 | 2 RHXs in normal inlet mode<br>2 RHXs in normal outlet mode<br>1 RHX in purge mode | 2 RHXs in normal inlet mode<br>2 RHXs in normal outlet mode<br>1 RHX in burn-out/wash-down mode |
| 5 | 3 RHXs in normal inlet mode<br>2 RHXs in normal outlet mode | 2 RHXs in normal inlet mode<br>2 RHXs in normal outlet mode<br>1 RHX in burn-out/wash-down mode |
| 6 | 3 RHXs in normal inlet mode<br>3 RHXs in normal outlet mode | 3 RHXs in normal inlet mode<br>2 RHXs in normal outlet mode<br>1 RHX in burnout/wash-down mode |
| 6 | 3 RHXs in normal inlet mode<br>3 RHXs in normal outlet mode | 2 RHXs in normal inlet mode<br>3 RHXs in normal outlet mode<br>1 RHX in burn-out/wash-down mode |
| 7 | 3 RHXs in normal inlet mode<br>3 RHXs in normal outlet mode<br>1 RHX in purge mode | 3 RHXs in normal inlet mode<br>3 RHXs in normal outlet mode<br>1 RHX in burn-out/wash-down mode |
| 7 | 4 RHXs in normal inlet mode<br>3 RHXs in normal outlet mode | 3 RHXs in normal inlet mode<br>3 RHXs in normal outlet mode<br>1 RHX in burn-out/wash-down mode |

The situations shown in Table-1 are examples only of the use of the inventive concepts described herein with regenerative fume incinerators having different numbers of regenerative heat exchangers. From these examples, it will be obvious to one of ordinary skill in the art that various other combinations of inlet, outlet, purge, burn-out, and wash-down modes of operation is possible using the above described concepts.

Further, the heat sink media beds can be cleaned with other cleaning fluids instead of water, steam, and compressed air as described above. For example, nitrogen or carbon-dioxide or some other gas could also be used to dislodge the deposited particulate matter from the surfaces of the heat sink media in the regenerative heat exchangers of the regenerative fume incinerator of the present invention. The use of all such cleaning-fluids is considered to fall within the scope of the present invention.

While an induced-draft regenerative thermal oxidizer system has been shown as an-example in FIGS. 1 and 2, the invention described herein can also be practiced with forced-draft regenerative fume incinerator systems. Again, while a negative purge system has been shown in FIGS. 1 and 2, it will be obvious that the invention can be practiced with a positive purge system also. As another example of possible obvious modifications, in the burn-out mode of operation, the heat sink media can be heated by passing hot ambient air through the inlet damper. The hot air can be generated by heating ambient air in an external combustion chamber or a heat exchanger for use in the heat sink media heating mode. As yet another example of possible obvious modifications, in the heat sink media cooling mode, the heat sink media can be cooled by blowing cold ambient air by a separate cooling air fan through the inlet damper. All of these modifications are also considered to fall within the scope of the invention claimed herein.

While preferred embodiments of the present invention have been shown and described herein, it will be obvious that such embodiments are provided by way of example only. Numerous variations, changes, and substitutions will occur to those skilled in the art without departing from the invention herein. Accordingly, it is intended that the invention be limited only by the spirit and scope of the appended claims.

We claim:

1. A Regenerative Fume Incinerator for cleaning a polluted gas, the Regenerative Fume Incinerator comprising: a combustion chamber which receives the polluted gas and oxidizes the oxidizable pollutants therein to produce a cleansed gas; and a plurality of regenerative heat exchangers, each regenerative heat exchanger comprising a regenerative heat exchanger compartment having a hot end and a cold end, the hot end of the regenerative heat exchanger compartment configured for fluid communication with the combustion chamber, the regenerative heat exchanger compartment further comprising a heat sink media bed located in between the hot and cold ends of the regenerative heat exchanger compartment in the path of flow of the polluted gas and the cleansed gas and a deposited matter removal means for dislodging deposited matter from the surface of the heat sink media within the regenerative heat exchanger compartment, the deposited matter removal means comprising at least one spray pipe containing a cleaning fluid, the cleaning fluid being at a pressure greater than the gas pressure within the regenerative heat exchanger compartment, the spray pipe located within the heat sink media bed to direct the cleaning fluid therein toward at least some of the surfaces of the heat sink media to physically dislodge the deposited matter thereon, the cleaning fluid flowing from a hot zone of the heat sink media bed to a less hot zone of the heat sink media bed, and a flow control means for the selective introduction of the polluted gas into the regenerative heat exchanger compartment and for the selective removal of the cleansed gas from the regenerative heat exchanger compartment, the flow control means being located at the cold end of the regenerative heat exchanger and configured for fluid communication with the cold end of the regenerative heat exchanger compartment.

2. The Regenerative Fume Incinerator of claim 1, which further comprises a first temperature measuring means located within the heat sink media bed.

3. The Regenerative Fume Incinerator of claim 1, wherein the heat sink media bed is divided into an upper heat sink media bed section and a lower heat sink media bed section and the spray pipe is located in the space between the upper heat sink media bed section and the lower heat sink media bed section, the spray pipe directing the cleaning fluid from the hot upper end of the lower heat sink media bed section to the less hot lower end of the lower heat sink media bed section.

4. The Regenerative Fume Incinerator of claim 3, which further comprises a first temperature measuring means located within the space between the upper heat sink media bed section and the lower heat sink media bed section.

5. The Regenerative Fume Incinerator of claim 1, wherein the cleaning fluid is water.

6. The Regenerative Fume Incinerator of claim 1, wherein the cleaning fluid is steam.

7. The Regenerative Fume Incinerator of claim 1, wherein the cleaning fluid is air.

8. The Regenerative Fume Incinerator of claim 1, which further comprises a temperature measuring means located in the cold end of the regenerative heat exchanger compartment.

9. The Regenerative Fume Incinerator of claim 2, which further comprises a second temperature measuring means located in the cold end of the regenerative heat exchanger compartment.

10. The Regenerative Fume Incinerator of claim 2 which further comprises a control means to perform on-line wash-down of the heat sink media in at least one of the regenerative heat exchangers of the Regenerative Fume Incinerator, the Regenerative Fume Incinerator control means comprising an algorithm to perform the following steps: (a) freeze the regenerative heat exchanger in a heat sink media cooling mode of operation while allowing the other regenerative heat exchangers to operate in their normal modes of operation, (b) read the measured temperature from the first temperature measuring means and continue to freeze the regenerative heat exchanger in the heat sink media cooling mode of operation until the measured temperature is less than a predetermined value, (c) operate the flow control means of the selected regenerative heat exchanger to substantially stop the flow of the polluted and cleansed gases into and out of the regenerative heat exchanger, (d) start the flow of the cleaning fluid into the spray-pipe of the deposited matter removal means in the regenerative heat exchanger to dislodge at least some of the deposited matter from the surface of the heat sink media within the selected regenerative heat exchanger, (e) stop the flow of the cleaning fluid into the spray-pipe of the deposited matter removal means of the regenerative heat exchanger after a predetermined period of time, (f) operate the flow control means to maintain the regenerative heat exchanger in a heat sink media heating mode of operation while monitoring the temperature measured by the first temperature measuring means of the regenerative heat exchanger, and (g) revert the regenerative heat exchanger back into the normal mode of operation when the temperature measured within the heat sink media of the regenerative heat exchanger by the first temperature measuring means of the regenerative heat exchanger reaches a predetermined level.

11. The Regenerative Fume Incinerator of claim 10, wherein the algorithm of the Regenerative Fume Incinerator control means automatically repeats sequential steps (a) to (g) in at least one of the remaining regenerative heat exchangers.

12. The Regenerative Fume Incinerator of claim 10, wherein the algorithm of the Regenerative Fume Incinerator control means automatically repeats sequential steps (a) to (g) in each of the remaining regenerative heat exchangers.

13. The Regenerative Fume Incinerator of claim 10, further comprising a second temperature measuring means located in the cold end of the regenerative heat exchanger compartment and wherein the algorithm further performs steps (i) to (iv) described below prior to performing steps (a) to (g): (i) freeze the regenerative heat exchanger in a heat sink media heating mode of operation while maintaining the other regenerative heat exchangers in their normal mode of operation, (ii) read the measured temperature from the second temperature sensing means of the regenerative heat exchanger and continue to freeze the selected regenerative heat exchanger in the heat sink media heating mode of operation while the measured temperature is less than a predetermined value, (iii) stop the operation of the regenerative heat exchanger in the heat sink media heating mode of operation when the measured temperature is at least equal to the predetermined temperature, and (iv) operate the regenerative heat exchanger compartment in a heat sink media cooling mode of operation.

14. The Regenerative Fume Incinerator of claim 13, wherein the regenerative heat exchanger control means automatically repeats sequential steps (i) to (iv) and (a) to (g) in at least one of the remaining regenerative heat exchangers.

15. The Regenerative Fume Incinerator of claim 13, wherein the regenerative heat exchanger control means automatically repeats sequential steps (i) to (iv) and (a) to (g) in each of the remaining regenerative heat exchangers.

16. A Regenerative Fume Incinerator control system to perform on-line wash-down of the heat sink media in a regenerative heat exchanger of a Regenerative Fume Incinerator, the regenerative heat exchanger having at least one cleaning fluid spray-pipe, the spray pipe located within the heat sink media bed to direct the cleaning fluid therein toward at least some of the surfaces of the heat sink media to physically dislodge the deposited matter thereon, the cleaning fluid flowing from a hot zone of the heat sink media bed to a less hot zone of the heat sink media bed, and a first temperature measuring means located within the heat sink media bed of the regenerative heat exchanger, the regenerative heat exchanger further having a second temperature measuring means located under the heat sink media bed of the regenerative heat exchanger, the regenerative heat exchanger further having a flow control means for the selective introduction of the polluted gas into the regenerative heat exchanger compartment and for the selective removal of the cleansed gas from the regenerative heat exchanger compartment, the flow control means being located at the cold end of the regenerative heat exchanger and configured for fluid communication with the cold end of the regenerative heat exchanger compartment, the Regenerative Fume Incinerator control system comprising an algorithm to perform the following steps: (a) freeze the regenerative heat exchanger in a heat sink media cooling mode of operation while maintaining the other regenerative heat exchangers in their normal mode of operation, (b) read the measured temperature from the first temperature measuring means and continue to freeze the selected regenerative heat exchanger in the heat sink media cooling mode of operation until the measured temperature is less than a predetermined value, (c) operate the flow control means of the regenerative heat exchanger to stop the flow of the polluted and cleansed gases into and out of the regenerative heat exchanger, and (d) start the flow of the cleaning fluid into the spraypipe of the regenerative heat exchanger to dislodge the deposited matter from the surface of the heat sink media within the regenerative heat exchanger.

17. The Regenerative Fume Incinerator control system of claim 16, further including step (e) of stopping the flow of the cleaning fluid into the spray-pipe of the regenerative heat exchanger after a predetermined period of time.

18. The Regenerative Fume Incinerator control system of claim 17, further including step (f) of operating the flow control means of the regenerative heat exchanger in the heat sink media heating mode of operation while monitoring the temperature measured by the first temperature measuring means within the regenerative heat exchanger.

19. The Regenerative Fume Incinerator control system of claim 18, further including step (g) of reverting the selected regenerative heat exchanger back into the normal mode of operation when the temperature measured within the heat sink media of the regenerative heat exchanger by the first temperature measuring means of the regenerative heat exchanger reaches a predetermined value.

20. The Regenerative Fume Incinerator control system of claim 19, wherein the algorithm automatically repeats sequential steps (a) to (g) in at least one of the remaining regenerative heat exchangers.

21. The Regenerative Fume Incinerator control system of claim 19, wherein the algorithm automatically repeats sequential steps (a) to (g) in each of the remaining regenerative heat exchangers.

22. The Regenerative Fume Incinerator control system of claim 19, wherein the algorithm further performs steps (i) to (iv) described below prior to performing steps (a) to (g) (i) freeze the selected regenerative heat exchanger in the heat sink media heating mode of operation while maintaining the other regenerative heat exchangers in their normal mode of operation, (ii) read the measured temperature from the second temperature sensing means within the regenerative heat exchanger compartment of the selected regenerative heat exchanger and continue to freeze the regenerative heat exchanger in the heat sink media heating mode of operation while the measured temperature is less than a predetermined value, (iii) stop the operation of the regenerative heat exchanger in the heat sink media heating mode of operation when the measured temperature is at least equal to a predetermined value, and (iv) operate the regenerative heat exchanger compartment in the heat sink media cooling mode of operation.

23. The Regenerative Fume Incinerator control system of claim 22 wherein the algorithm automatically repeats sequential steps (i) to (iv) and (a) to (g) in at least one of the remaining regenerative heat exchangers.

24. The Regenerative Fume Incinerator control system of claim 22 wherein the algorithm automatically repeats sequential steps (i) to (iv) and (a) to (g) in each of the remaining regenerative heat exchangers.

* * * * *